US007086938B2

(12) United States Patent
Tuovinen

(10) Patent No.: US 7,086,938 B2
(45) Date of Patent: Aug. 8, 2006

(54) GRINDING SEGMENT AND GRINDER STONE

(75) Inventor: Olli Tuovinen, Tampere (FI)

(73) Assignee: Metso Paper Inc., Helsinki (FI)

( * ) Notice: Subject to any disclaimer, the term of this patent is extended or adjusted under 35 U.S.C. 154(b) by 190 days.

(21) Appl. No.: 10/471,959

(22) PCT Filed: Mar. 15, 2002

(86) PCT No.: PCT/FI02/00217

§ 371 (c)(1),
(2), (4) Date: Mar. 10, 2004

(87) PCT Pub. No.: WO02/075040

PCT Pub. Date: Sep. 26, 2002

(65) Prior Publication Data

US 2004/0166791 A1 Aug. 26, 2004

(30) Foreign Application Priority Data

Mar. 16, 2001 (FI) ..... 20010534

(51) Int. Cl.
*B23F 21/03* (2006.01)

(52) U.S. Cl. ..... 451/540; 451/542

(58) Field of Classification Search ..... 451/540–544
See application file for complete search history.

(56) References Cited

U.S. PATENT DOCUMENTS

| | | | | |
|---|---|---|---|---|
| 2,032,484 A | | 3/1936 | Jeppson | |
| 2,054,771 A | * | 9/1936 | Larsson | 451/543 |
| 2,141,608 A | * | 12/1938 | Larsson | 451/542 |
| 2,745,226 A | | 5/1956 | Beth | |
| 2,769,286 A | * | 11/1956 | Beth | 451/542 |
| 4,642,862 A | * | 2/1987 | Muhle et al. | 492/53 |

FOREIGN PATENT DOCUMENTS

| | | |
|---|---|---|
| DE | 3 010 394 A1 | 10/1981 |
| DE | 34 13 890 C2 | 10/1984 |
| DE | 38 23 837 A1 | 1/1990 |

* cited by examiner

*Primary Examiner*—Hadi Shakeri
(74) *Attorney, Agent, or Firm*—Alston & Bird LLP

(57) ABSTRACT

The invention relates to a grinding segment comprising a ceramic part manufactured of grinding ceramic material and provided with a fastening hole, through which the grinding segment is attached to a frame of a grinder stone by means of a fastening bolt. A fastening sleeve is arranged in the fastening hole, and the fastening bolt is supplied through the sleeve. The fastening sleeve is pressed against the frame of the grinder stone due to the fastening force. A space filled with bonding agent is formed between the ceramic part of the fastening sleeve to join them together. The invention further relates to a grinder stone comprising a cylindrical frame and grinding segments according to the invention.

11 Claims, 4 Drawing Sheets

GRINDING SEGMENT AND GRINDER STONE

BACKGROUND OF THE INVENTION

1. Field of the Invention

Figure 1:
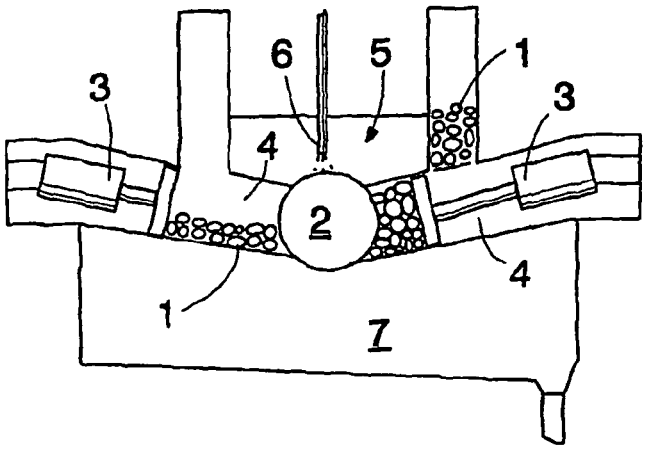

The invention relates to a grinding segment comprising a ceramic part manufactured of grinding ceramic material, at least one fastening hole formed in the ceramic part for fastening the grinding segment by means of a fastening element to the outer surface of a frame of a grinder stone used in defibering of wood.

The invention further relates to a grinder stone for defibering wood, comprising a cylindrical frame, grinding segments made of grinding ceramic material, arranged on the frame's outer circumference and fastened in place by means of a fastening element arranged through at least one fastening hole formed in the segments, and a shaft, around which the grinder stone is arranged to be rotated during grinding.

2. Description of Related Art

Wood is typically ground into fibres by means of grinding machines, where logs are pressed against the surface of a rotating grinder stone. Water is simultaneously sprayed to purify and cool the grinder stone. The stone makes the wood fibre matrix vibrate, whereafter the wood fibres are released from the logs to provide a pulp suspension. Wood can be ground under both a normal pressure and an overpressure.

The frame of the grinder stone is usually made of concrete. A grinding surface consists of separate ceramic grinding segments attached to the frame. The prior art also teaches arrangements, where concrete frames are replaced with a steel drum. Steel is better able to withstand high grinding forces generated during grinding than concrete. Also in a steel drum the grinding segments are attached with suitable bolt mechanisms to the outer circumference of the drum to form the grinding surface of the grinder stone. Different segment fastening mechanisms are disclosed e.g. in FI 67,240. In this reference, a layer of rubber is disposed between a grinding segment and the steel drum to balance the loads between the segment and the frame.

The prior art also teaches different fastening bolt mechanisms, which compensate for varying dimensions resulting from different thermal expansion coefficients of the ceramic segment and the frame of the grinder stone. However, such bolts are rather complicated and therefore also expensive. Furthermore, it is possible to place semi-spherical washers between such bolts and the segment in order that the stresses resulting from the fastening will be distributed more evenly in the segment and the segment will be able to withstand the fastening forces. Failure of a fastening bolt during use results in great damage and an interruption of production. Another problem with the present arrangements is that the fastening forces subject the ceramic segment to compression stress, which can break the segment usually from below the washer. It is thus necessary to restrict the fastening force, which in some cases can lead to insufficient fastening of the segment. During grinding, such a loose segment can start vibrating and will be damaged. The ceramic materials used in grinding are highly wear-resistant and hard, yet brittle. However, in practice grinding segments cannot be manufactured from more resistant ceramic materials, since the ceramic material used in grinding of wood must be of a particular type and sufficiently porous to provide a desired grinding effect. Also, quality characteristics set for mechanical pulp require use of the present grinding ceramic materials.

BRIEF SUMMARY OF THE INVENTION

An objective of the present invention is to provide a new and improved grinding segment and grinder stone for defibering wood.

A grinding segment according to the invention is characterized in that a fastening sleeve is arranged in the fastening hole, that a layer of bonding agent is formed between the fastening sleeve and the ceramic part to join them together, and that the fastening element is arranged to press the fastening sleeve to the frame of the grinder stone.

Further, a grinder stone according to the invention is characterized in that each grinding segment comprises a fastening sleeve in connection with the fastening hole, that the fastening element is arranged to press the fastening sleeve to the frame of the stone, and that a layer of bonding agent is formed between the fastening sleeve and the ceramic part to join them together.

According to a basic idea of the invention, grinding segments placed on the outer surface of the grinder stone comprise a ceramic part manufactured of a suitable grinding ceramic material and provided with at least one fastening hole for a fastening bolt or some other similar fastening element. A fastening sleeve is arranged in each fastening hole, so that between the sleeve and the fastening hole there remains a space, where a layer of suitable bonding agent is formed. The fastening sleeve and the ceramic part are connected by means of the layer of bonding agent. The fastening bolts thus press the fastening sleeve against the frame of the grinder stone, wherefore the fastening force of the segment can be greater than previously, and firmer fastening is provided. Furthermore, since the fastening element, the fastening sleeve and the frame of the grinder stone are made of the same material, thermal expansion is under control. Also, the layer of bonding agent between the sleeve and the ceramic part balances the loads.

Furthermore, according to a basic idea of a preferred embodiment of the invention, a predetermined proportion of the ceramic part of the grinding segment, beginning from the bottom of the segment towards the grinding surface, is impregnated with bonding agent, such as suitable plastic. This avoids the occurrence of breakage and makes the segment more capable of withstanding loading. Also, the joint between the fastening sleeve and the ceramic material will be more secure.

According to a basic idea of another preferred embodiment of the invention, side surfaces of the grinding segment, which are transverse to the bottom of the segment and possibly also to the grinding surface, are provided with damping layers made of bonding agent. The bottom of the segment thus comprises an intermediate layer in the area of the ceramic part to balance loads and possible unevenness of the fastening surface. When the grinder stone is being used, the side layers in the side surfaces of adjacent grinding segments are positioned tightly against one another, and a point load subjected on an individual segment is therefore also distributed onto adjacent segments.

It should be mentioned that in the present application the term 'grinder stone' refers to the stone frame and the assembly of the grinding segments and fastening means arranged thereto.

BRIEF DESCRIPTION OF THE SEVERAL VIEWS OF THE DRAWING(S)

Figure 2:
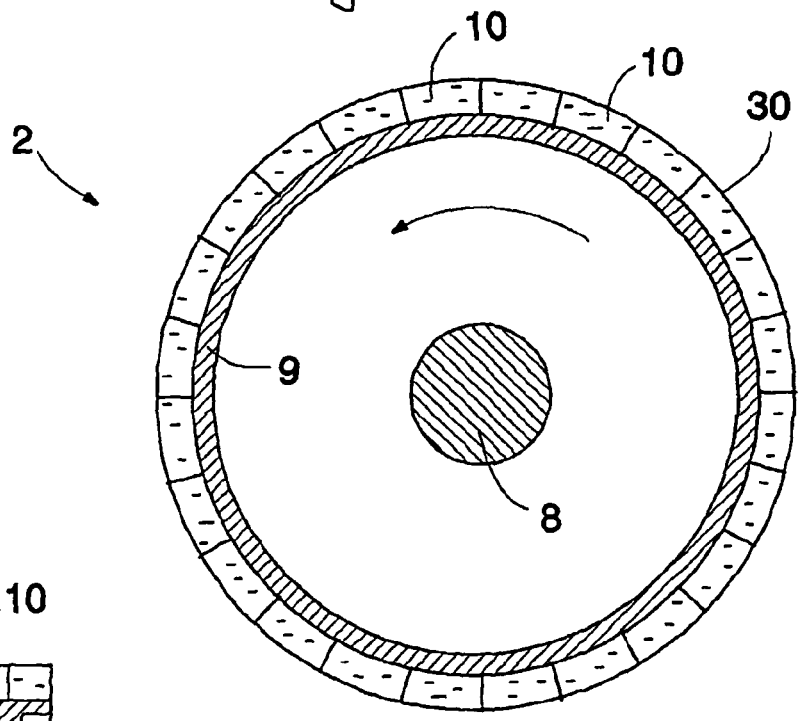
Figure 3:
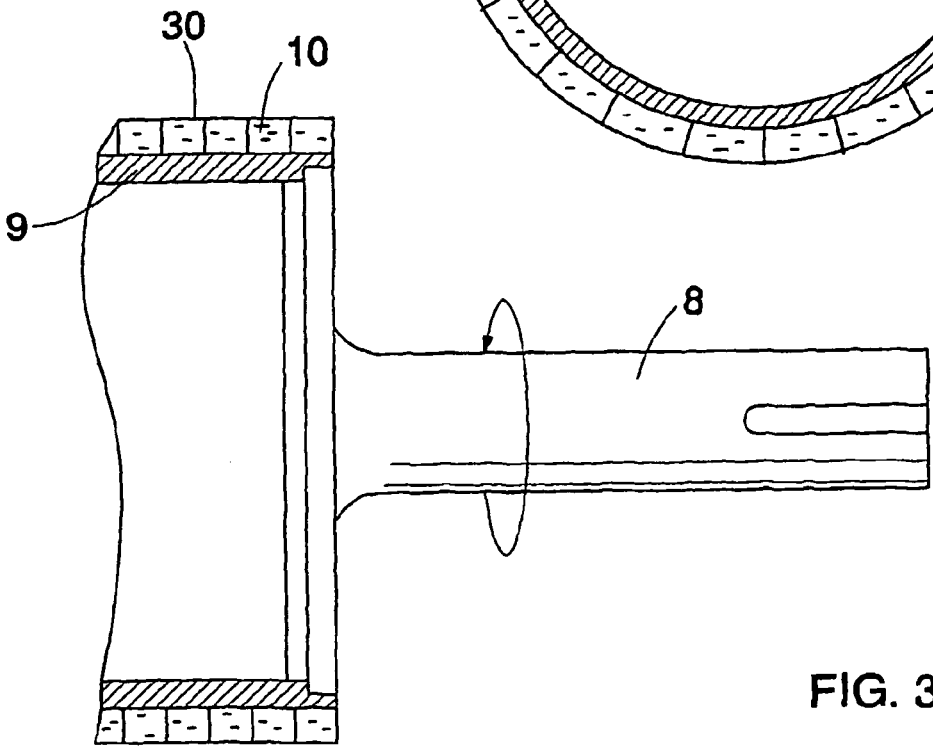
Figure 4:
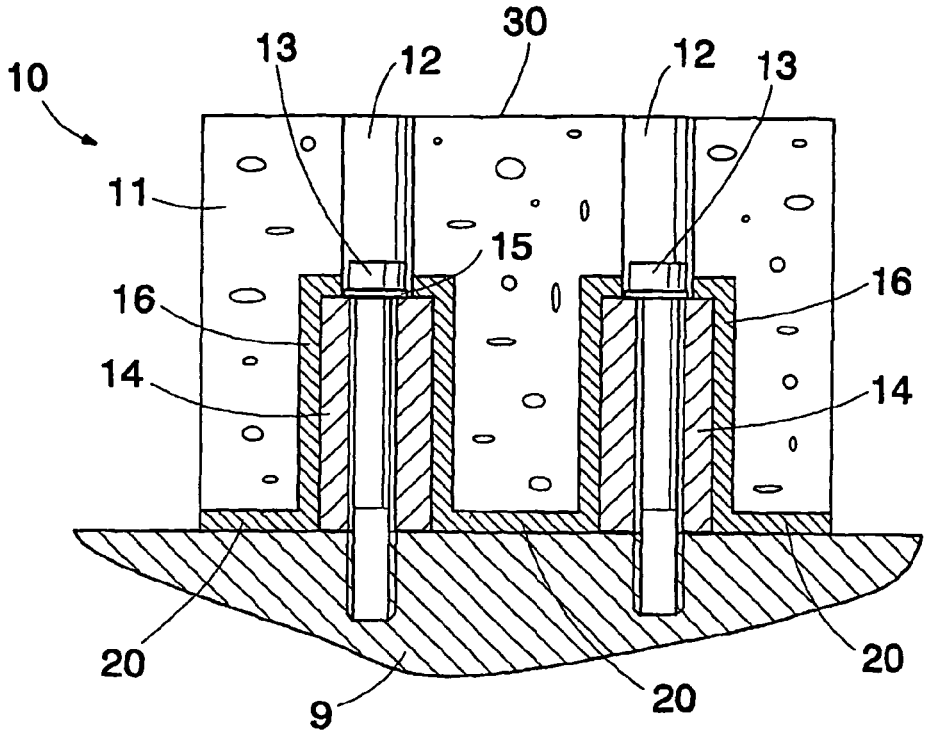
Figure 5:
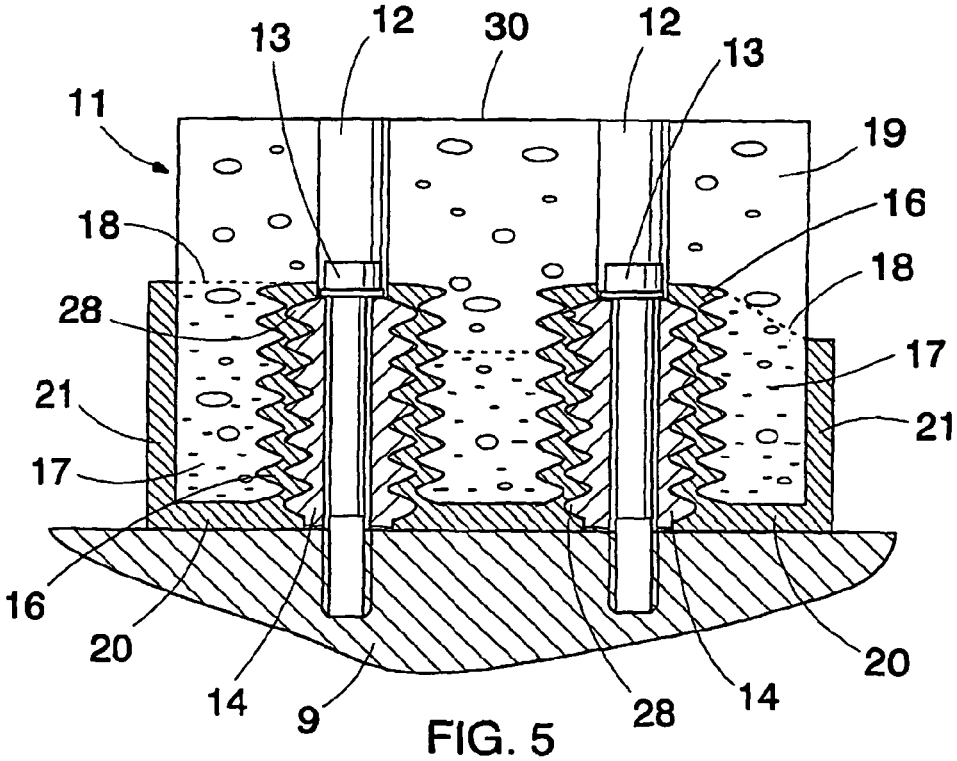
Figure 6:
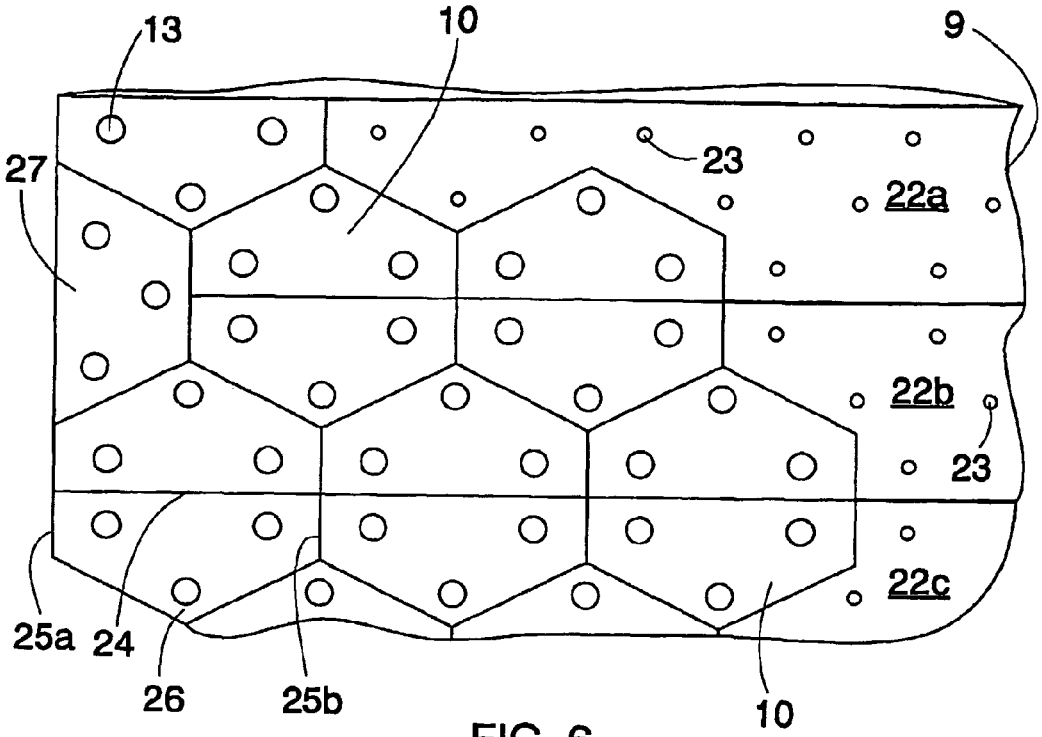
Figure 7:
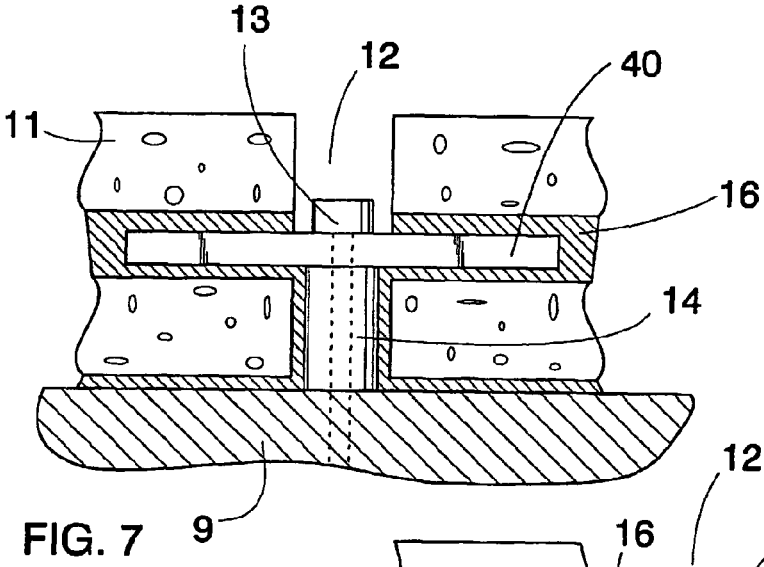
Figure 8:
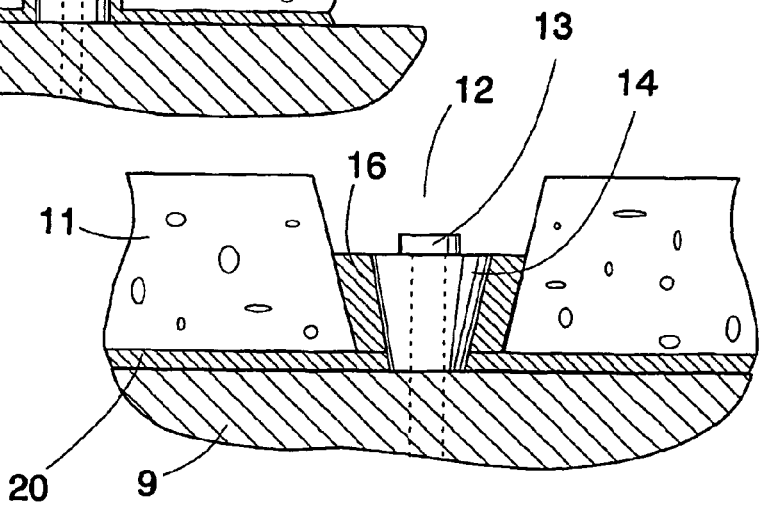
Figure 9A:
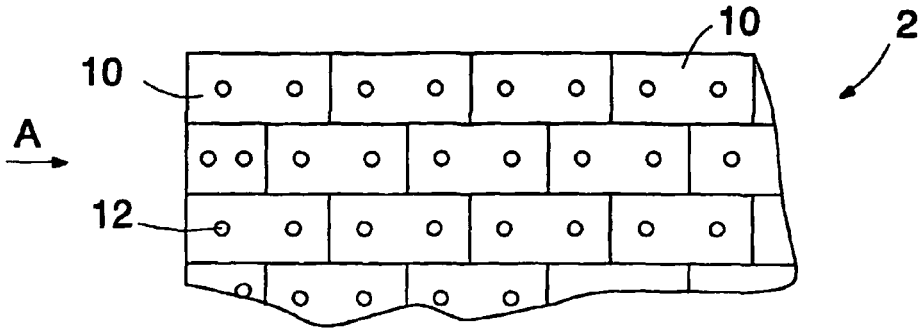
Figure 9B:
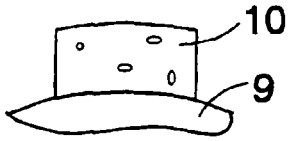
Figure 10A:
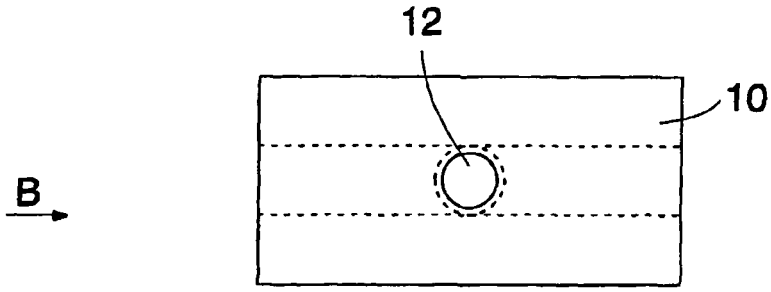
Figure 10B:
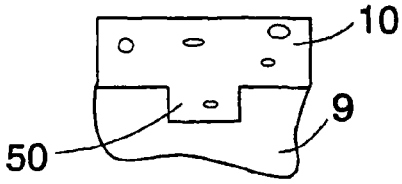
Figure 10C:
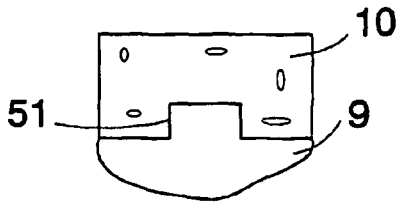

The invention will be described in more detail in the accompanying drawings, in which FIG. 1 shows schematically a grinding apparatus, where a grinding segment according to the invention can be used, FIG. 2 is a schematic end view of a grinder stone according to the invention, and FIG. 3 is a schematic side view of a part of the grinder stone according to the invention, FIGS. 4 and 5 are schematic sectional views of grinding segments according to the invention and the fastening thereof, FIG. 6 shows schematically placement of segments according to the invention on the outer circumference of a frame of the grinder stone, FIGS. 7 and 8 are schematic sectional side views of embodiments of the invention, FIG. 9*a* is a schematic top view of a part of a grinder stone according to the invention, and FIG. 9*b* shows schematically a grinding segment according to FIG. 9*a* viewed from direction A, and FIG. 10*a* is a schematic top view of a grinding segment according to the invention, and FIGS. 10*b* and 10*c* show embodiments of the grinding segment viewed from direction B.

DETAILED DESCRIPTION OF THE INVENTION

FIG. 1 shows a grinding apparatus for detaching fibres from logs 1 or some other similar wood material by means of a rotating cylindrical grinder stone 2. The logs 1 are pressed by feeder means, such as feed cylinders 3, from a feed chamber 4 against the outer surface of the grinder stone 2. Water is simultaneously supplied from nozzles 6 to a grinding chamber 5. The fibre that has been released from the logs accumulates with the sprayed water in a grinder pit 7 at the bottom of the grinding chamber and is conducted therefrom to subsequent processing steps. The grinding apparatus is considered fully known to a person skilled in the art, wherefore the structure and operation thereof do not have to be described in more detail herein.

FIG. 2 shows, in a simplified manner, a grinder stone 2, which rotates around a shaft 8. The grinder stone comprises a preferably metal cylindrical frame 9, the outer circumference of which is provided with adjacent grinding segments 10 typically made of ceramic, a suitable ceramic mixture or some other corresponding material. The segments constitute a grinding surface 30 of the grinder stone that processes the wood. The fastening of the grinding segments to the frame will be described in more detail in FIGS. 4 and 5 below. FIG. 3 is a side view of a part of the grinder stone.

FIG. 4 shows a cross-sectional view of the structure of the grinding segment 10. The segment comprises a ceramic part 11 manufactured of ceramic or some other material that is suitable for grinding. The shape and size of the segment can be selected separately in each case. The bottom of the segment is typically curved and corresponds to the shape of the outer circumference of the stone frame. The outer surface of the segment is also curved, as shown in FIG. 2, for example. Fastening holes 12 extend through the ceramic part 11 for fastening bolts 13 or some other similar fastening means that are screwed onto the frame 9 of the grinder stone. Three or more fastening bolts are preferably used for each segment. According to the basic idea of the invention, the segment comprises fastening sleeves 14, preferably made of steel or the like, which coincide with the fastening holes. A fastening bolt goes through a fastening sleeve. For the sake of clarity, the figure shows the fastening sleeve with a rather thick wall structure. The fastening force provided by the fastening bolt does not directly cause compression stress in the ceramic part, but the fastening bolt tightens the fastening sleeve against the frame of the grinder stone. Since the fastening bolt affects directly the fastening sleeve of steel, it is no longer necessary to use such conventional structures as semi-spherical washers for balancing stresses, but a standard locking washer 15, such as a spring washer or the like, can be disposed between the sleeve and the bolt. Due to the fastening sleeve, the tightening force does not have to be restricted according to the compression resistance of the ceramic material, but such a high fastening force can be selected that the segment is guaranteed to stay in place. Another advantage of the arrangement is that the thermal expansion coefficients of the fastening bolt, the fastening sleeve and the frame of the grinder stone are substantially equal since the components are made of the same material, which is typically steel. Therefore thermal expansion resulting from heating of the grinder stone is always under control, and there is no need for complicated and expensive special bolts to compensate for thermal expansion.

As shown further in FIG. 4, a space filled with bonding agent is provided between the fastening sleeve 14 and the ceramic part 11. The bonding agent can be for example cast resin, such as vinyl ester-polyurethane (VEUH), vinyl ester (VE), polyurethane (PU), and epoxy resins. Other possible bonding agents include natural rubber, polystyrene (PS), poly-phenylenesulphide (PPS), polyamide (PA) and other suitable plastic materials. Moreover, the bonding agent can be reinforced with fibre or it can contain filler. The fibre reinforcement can consist of such fibre material as a glass fibre mat or a glass fibre mesh, staple glass fibre, milled glass fibre, kevlar, carbon fibre or some other suitable fibre material. The filler can be aluminium oxide, silica sand, kaolin, talc or some other suitable filler. In some cases, different cements and metallic soldering materials can also be used as bonding agent. The fastening force is transmitted from the fastening sleeve to the ceramic part via the aforementioned layer 16 of bonding agent. The layer has a thickness of 0.1 to 3 mm, preferably 0.3 to 1 mm. The layer of bonding agent is also able to compensate for deviations between the ceramic part 11 and the fastening sleeve 14 resulting from different thermal expansion coefficients of the materials. Furthermore, the bottom of the ceramic part is preferably provided with a layer of corresponding bonding agent, which forms a damping intermediate layer 20 between the segment and the frame. The intermediate layer damps percussive loads possibly directed at the segment during the grinding of wood, thus preventing segment breakage. It also prevents vibration in the segment. Furthermore, the intermediate layer 20 balances any slight unevenness that possibly occurs between the joint surfaces of the segment and the frame of the grinder stone, thus improving the fastening. Due to the intermediate layer, the segment bottom and the fastening surface formed in the frame of the grinder stone do not have to be perfectly finished during the manufacture, which reduces the costs of manufacture. The intermediate layer has a thickness of preferably 1 to 3 mm. On the other hand, the intermediate layer is not necessary.

The segment shown in FIG. 5 mainly corresponds to the segment shown in FIG. 4. However, in FIG. 5 a proportion of the bottom section 17 of the segment is impregnated with plastic bonding agent beginning from the segment's bottom towards a grinding surface 30 of the segment. The impregnated bottom section 17 prevents the formation of ruptures in the segments and improves the joint between the ceramic part and the fastening sleeve. The impregnation is preferably carried out from the lower surface of the segment approximately to the level of the upper end of the fastening sleeves, but it can also be performed closer to the upper surface of the segment. For the sake of illustration, a broken line 18 in the figure shows different possible locations of the interface between the impregnated bottom section 17 and the surface section 19. Between the grinding surface 30 and the impregnated part 17 of the segment there is a nonimpregnated section with good grinding properties. The grinding section of the grinder stone can be sharpened as the need arises, so that when the segment is finally replaced as a result of normal wearing, the grinding section has been used all the way to the impregnated section. Furthermore, the segment side surfaces are preferably provided with side layers 21 formed of bonding agent, which act as damping parts between adjacent segments. The side layers 21 have a thickness of preferably 1 to 3 mm and they extend preferably substantially to the level of the impregnated bottom section 17 of the segment. The side layers are preferably arranged in all the sides of the segment that are transverse to the grinding surface. If required, some or all of the side layers can be eliminated. Furthermore, the fastening sleeves 14 of the segment according to FIG. 5 differ from the cylindrical sleeves shown in FIG. 4. In FIG. 5, the outer surfaces of the fastening sleeves comprise one or more protrusions 28. The sleeve's outer surface is preferably wavelike, and the wave's cross-section is similar to a sine wave. The wave shape can also be similar to a square wave, a saw-tooth wave, etc. The protrusion can also resemble a thread. Correspondingly, the circumference of the fastening hole formed in the ceramic part can be provided with one or more protrusions in the section corresponding to the level of the fastening sleeve, the protrusions preferably corresponding to those in the sleeve. The shapes of the protrusions in the ceramic part and in the fastening sleeve can also differ from one another, if necessary, and protrusions can only be provided in one element and not in the other. The purpose of the protrusions is to improve the joint between the ceramic part and the fastening sleeve, and the shape of the protrusions can be used to adjust the behaviour of the segments under stress.

The intermediate layer 20 and the side layers 21 shown in FIG. 5 can also be components made of suitable bonding agent and separate from the ceramic part 11. Furthermore, the bonding agent used in the intermediate layer 20, the side layers 21 and the space between the fastening sleeve 14 and the ceramic part 11 can be reinforced with glass fibre or the like.

FIG. 6 shows a preferred arrangement for fastening segments. The outer circumference of the frame 9 of the grinder stone is provided with planar sections 22*a* to 22*c*, parallel to the shaft of the grinder stone, for the segments. The planar sections are also provided with fastening holes 23, so that the segments 10 can be attached to the frame of the grinder stone by means of fastening bolts 13. As shown in the figure, each segment is provided with three fastening bolts to ensure stable fastening that prevents swaying. Viewed in the direction of the radius of the grinder stone, the segments 9 shown in the figure comprise a base 24, two sections 25*a* and 25*b* that are perpendicular to the base, and a triangular apex 26 extending from the sections. Such sectors can be arranged in the planar sections of the frame in alternating directions, such that the bases 24 are parallel to the frame shaft or to the edge of the planar section, and the apices of adjacent segments thus point in opposite directions. In such a manner the segments can be positioned tightly against one another to constitute a grinding surface. The segments of the entire grinder stone can thus be of the same shape, excluding end segments 27 to be placed at the end of the grinder stone. When damaged or worn-out segments are being replaced, it is not necessary to remove the grinder stone from the grinding apparatus, but segments can be detached and attached while the stone is in place, e.g. via an opening provided in the grinding apparatus for sharpening the grinder stone.

FIG. 7 shows an arrangement, where a transverse support element 40 is arranged between the upper end of the fastening sleeve 14 and the fastening bolt 13 to secure the fastening of the segment. The segment is provided with an opening, transverse to the fastening hole 12, for receiving the support element 40. Bonding agent 16 is applied between the support element and the transverse opening. The support element is preferably rectangular, but the shape can be selected suitably in each case.

FIG. 8 shows a conical fastening sleeve 14, which is arranged with the greater sleeve diameter on the side of the segment's upper surface. The conical fastening sleeve ensures firm fastening of the segment. The fastening sleeve 14 can also be a separate piece, which is precoated with a required layer 16 of bonding agent and thereafter arranged in a fastening hole 12 in the ceramic part 11. When the fastening element 13 is being tightened, the layer 16 of bonding agent in the fastening sleeve is pressed against the ceramic part 11 to join the part to the fastening sleeve. On the other hand, the layer of bonding agent between the fastening sleeve and the ceramic part can be a preformed separate piece.

The grinder stone 2 shown in FIG. 9*a* comprises rectangular grinding segments 10, which are attached to the stone's outer surface with two fastening bolts or a corresponding fastening element. As shown in FIG. 9*b*, the grinding segments 10 have a curved bottom surface, so that the segment rests against the curved outer surface of the frame 9 of the grinder stone.

FIGS. 10*a* to 10*c* show grinding segments 10, where the bottoms comprise one or more protrusions 50 or grooves 51. The outer surface of the frame 9 of the grinder stone is also provided with sections that fit in the aforementioned protrusions or grooves, so that shear forces produced during the use of the grinder stone can be transmitted from the grinding segment to the stone frame. Such fastening of the grinding segment is firm, and only one tightening bolt per segment may be sufficient. In the arrangements shown in FIGS. 9*a* to 10*c*, each fastening hole is provided with a fastening sleeve according to the invention.

The drawings and the related description are only intended to illustrate the inventive idea. The details of the invention can vary within the scope of the claims. It is thus clear that even if the segments advantageously have a similar shape as shown in FIG. 6, the fastening arrangement according to the invention can also be applied in connection with segments of other shapes. The bonding agent to be used between the fastening sleeve and the ceramic part, the bonding agent that impregnates the segment, the bonding agent in the bottom of the segment, and the bonding agents in the side layers of the segment can be different in some cases, although with respect to the manufacturing technique it is advantageous to mould all the aforementioned layers of bonding agent simultaneously. Furthermore, the intermediate layer can be made to extend beyond the fastening sleeve at the bottom of the segment, so that when the segment is tightened in place, the intermediate layer is compressed to some extent so as to produce a predetermined initial tension, which prevents occurrence of vibrations. Also, even though the invention is described in the figures in connection with a grinder stone of a steel frame, the invention can also be applied in grinder stones with a frame of concrete.

The invention claimed is:

1. A grinding segment comprising a ceramic part manufactured of grinding ceramic material, at least one fastening hole formed in the ceramic part for fastening the grinding segment by means of a fastening element to the outer surface frame of a grinder stone used in defibering of wood, fastening sleeve arranged in the fastening hole, and a layer of bonding agent formed between the fastening sleeve and the ceramic part to join them together, the fastening element being arranged to press the fastening sleeve to the frame of the grinder stone, wherein a predetermined proportion of the ceramic part of the grinding segment is impregnated with bonding agent beginning from the bottom of the segment towards the grinding surface thereof.

2. A grinding segment according to claim 1, wherein the outer surface of the fastening sleeve is provided with protrusions.

3. A grinding segment according to claim 1, wherein the inner surface of the fastening hole formed in the ceramic part is provided with protrusions over a section corresponding to the fastening sleeve.

4. A grinding segment according to claim 1, wherein the bottom of the grinding segment in the area of the ceramic part is provided with an intermediate layer of bonding agent arranged to remain between the frame of the grinder stone and the ceramic part of the grinding segment when the segment is installed in place.

5. A grinding segment according to claim 1, wherein at least some of the sides of the grinding segment, transverse to a grinding surface are provided with side layers of bonding agent, which are arranged to be disposed towards adjacent grinding segments when the segment is in place in the grinder stone.

6. A grinding segment according to claim 1, wherein a proportion of the grinding segment that corresponds substantially to the fastening sleeves is impregnated with bonding agent beginning from the bottom of the segment towards the grinding surface.

7. A grinding segment according to claim 1, wherein the bonding agent is reinforced with fibre.

8. A grinding segment according to claim 1, wherein a proportion of the grinding segment about the at least one fastening hole is impregnated with bonding agent beginning from the bottom of the segment towards the grinding surface thereof.

9. A grinder stone for defibering wood, comprising a cylindrical frame, grinding segments made of grinding ceramic material and arranged on the frame's outer circumference, each grinding segment being fastened to the frame by a fastening element extending through a fastening hole defined by the respective grinding segment, and a shaft around which the grinder stone is arranged to be rotated during grinding, each grinding segment comprising a fastening sleeve disposed within the fastening hole, wherein the fastening element is configured to secure the fastening sleeve to the frame of the grinder stone, and wherein a bonding agent is inserted between the fastening sleeve and a surface of the grinding segment defining the fastening hole so as to secure the fastening sleeve within the fastening hole.

10. A grinder stone according to claim 9, wherein the outer circumference of the frame of the grinder stone is provided with planar sections, parallel to the shaft of the stone, for fastening the grinding segments thereto.

11. A grinder stone according to claim 9, wherein each grinding segment includes an engagement surface for engaging the frame, and wherein the fastening sleeve extends from the engagement surface and into the grinding segment such that fastening element exerts a securing force for securing the grinding segment to the frame through the fastening sleeve.

* * * * *

UNITED STATES PATENT AND TRADEMARK OFFICE

CERTIFICATE OF CORRECTION

PATENT NO. : 7,086,938 B2
APPLICATION NO. : 10/471959
DATED : August 8, 2006
INVENTOR(S) : Tuovinen It is certified that error appears in the above-identified patent and that said Letters Patent is hereby corrected as shown below:

Column 7,

Line 7, after "surface" insert --of a--.

Line 8, after "of wood," insert -- a--

Column 8,

Line 33, after "that" insert --the--.

Signed and Sealed this

Twenty-sixth Day of December, 2006

JON W. DUDAS
*Director of the United States Patent and Trademark Office*